US005333414A

United States Patent [19]

Lee

[11] Patent Number: 5,333,414

[45] Date of Patent: Aug. 2, 1994

[54] SAND BELT DEVICE

[76] Inventor: Tai-Wang Lee, No. 68-57, Yung-Li Rd., Tai-Ping Hsiang, Taichung Hsien, Taiwan

[21] Appl. No.: 24,603

[22] Filed: Mar. 1, 1993

[51] Int. Cl.[5] ..... B24B 23/06

[52] U.S. Cl. ..... 51/170 EB

[58] Field of Search ..... 51/170 R, 170 EB

[56] References Cited

U.S. PATENT DOCUMENTS

| | | | |
|---|---|---|---|
| 3,643,385 | 2/1972 | Mikiya | 51/170 EB |
| 4,368,597 | 1/1983 | Fleckenstein | 51/170 EB |
| 4,578,906 | 4/1986 | Appleton | 51/170 EB |
| 4,858,390 | 8/1989 | Kenig | 51/170 EB |
| 5,031,362 | 7/1991 | Reiling et al. | 51/170 EB |
| 5,210,981 | 5/1993 | Urda | 51/170 EB |
| 5,235,784 | 8/1993 | Oki et al. | 51/170 EB |

*Primary Examiner*—Roscoe V. Parker
*Attorney, Agent, or Firm*—Hoffmann & Baron

[57] ABSTRACT

A sand belt device can be mounted detachably on a body portion of a portable grinding machine so as to replace a grinding wheel of the portable grinding machine. The sand belt device includes a positioning member which has a front part and a rear part that is fitted tightly and detachably around an annular flange of the body portion. The rear part has a hole through which a rotatable shaft of the body portion passes. A roller unit includes a driven roller and a driving roller which is mounted detachably on the rotatable shaft of the body portion and which is rotatable with the rotatable shaft. An elongated belt frame has a front end and a rear end that is attached stationarily and detachably to the front part of the positioning member. A supporting unit, which is mounted movably to the elongated belt frame, is used to support the driven roller so as to position the driven roller in front of the elongated belt frame. An endless sand belt passes over the roller unit and the elongated belt frame.

8 Claims, 6 Drawing Sheets

SAND BELT DEVICE

BACKGROUND OF THE INVENTION

1. Field of the Invention

This invention relates to a sand belt device, more particularly to a sand belt device which can be mounted detachably on a body portion of a portable grinding machine in order to replace a grinding wheel that is attached originally to the body portion.

2. Description of the Related Art

Referring to FIG. 1, a portable grinding machine (G) has a body portion (1) which includes a handle part (1*a*) and a head part (1*a*'). The head part (1*a*') has a casing (1*a*''), a rotatable shaft (1*b*) which extends out from the casing (1*a*''), and an annular flange (1*c*) which protrudes from the casing (1*a*'') and which is disposed around the rotatable shaft (1*b*). The portable grinding machine (G) further includes a grinding wheel (2) which is mounted detachably to the rotatable shaft (1*b*), and a housing (3) which covers the grinding wheel (2). The portable grinding machine (G) is used generally to remove a material from a workpiece with the grinding wheel (2). A polishing machine, which has an electrical driving mechanism and a sand belt mechanism, is necessary when polishing a surface of the workpiece. It is inconvenient and uneconomical to use a grinding machine and a polishing machine when grinding and polishing the workpiece.

SUMMARY OF THE INVENTION

Therefore, the objective of the present invention is to provide a new sand belt device that can be mounted detachably on the body portion of the portable grinding machine so as to replace the grinding wheel which is attached originally to the body portion, in order to polish a surface of a workpiece. The new sand belt device is actuated by the rotatable shaft of the body portion, and thus, another electrical driving mechanism to drive the sand belt device is not necessary.

Accordingly, a sand belt device of the present invention can be mounted detachably on a body portion of a portable grinding machine so as to replace a grinding wheel of the portable grinding machine in order to polish a surface of a workpiece. The body portion includes a casing, a rotatable shaft which extends out from the casing, and an annular flange which protrudes from the casing and which is disposed around the rotatable shaft. The sand belt device includes a positioning member that has a front part and a rear part which is fitted tightly and detachably around the annular flange of the body portion. The rear part has a hole through which the rotatable shaft of the body portion passes.

A roller unit includes a driven roller and a driving roller which is mounted detachably on the rotatable shaft of the body portion and which is rotatable with the rotatable shaft.

An elongated belt frame has a front end and a rear end that is attached stationarily and detachably to the front part of the positioning member. The elongated belt frame further has an elongated first face, which extends from the rear end to the front end, and an elongated second face which is opposite to the elongated first face.

A supporting means is used to support the driven roller so as to position the driven roller in front of the elongated belt frame. The supporting means is mounted movably and detachably to the elongated belt frame.

An endless sand belt passes over the driving and driven rollers of the roller unit and the elongated first and second faces of the elongated belt frame. The endless sand belt is actuated rotatably by the driving roller.

In addition, the rear part of the positioning member may include a clamp mechanism which has a substantially semicircular first member and a substantially semicircular second member that can be attached adjustably and detachably to the first member in order to clamp tightly the annular flange of the body portion when the first and second members are sleeved around the annular flange. The first and second members define cooperatively the hole of the rear part therebetween. The clamp mechanism further includes a C-shaped packing ring which is provided between the annular flange and the first and second members in order to improve the tightness of the clamp mechanism. The clamp mechanism may further include a ring member which protrudes rearward from a rear concave side of the first member in order to cover the C-shaped packing ring when the first and second members clamp the annular flange with the C-shaped packing ring provided therebetween so as to prevent the release of the C-shaped packing ring.

The front part of the positioning member may include a plate member which extends forward from a front convex side of the first member. The rear end of the elongated belt frame can be attached detachably to the plate member.

The supporting means may include a pair of opposite spaced elongated plate members which are disposed beside the elongated belt frame between the first and second faces of the elongated belt frame in a longitudinal direction of the same. Each of the elongated plate members has a front end extending forward relative to the elongated belt frame so as to hold rotatably the driven roller. One of the elongated plate members has a rear end which is attached detachably and movably to the elongated belt frame.

The sand belt device may further include a guiding piece which is attached to one of the elongated first and second faces of the elongated belt frame in order to facilitate rotation of the sand belt. The guiding piece may include a plastic layer and a graphite layer.

BRIEF DESCRIPTION OF THE DRAWINGS

Other features and advantages of the present invention will become apparent in the following detailed description of the preferred embodiment, with reference to the accompanying drawings, in which.

DETAILED DESCRIPTION OF THE PREFERRED EMBODIMENT

Figure 1:
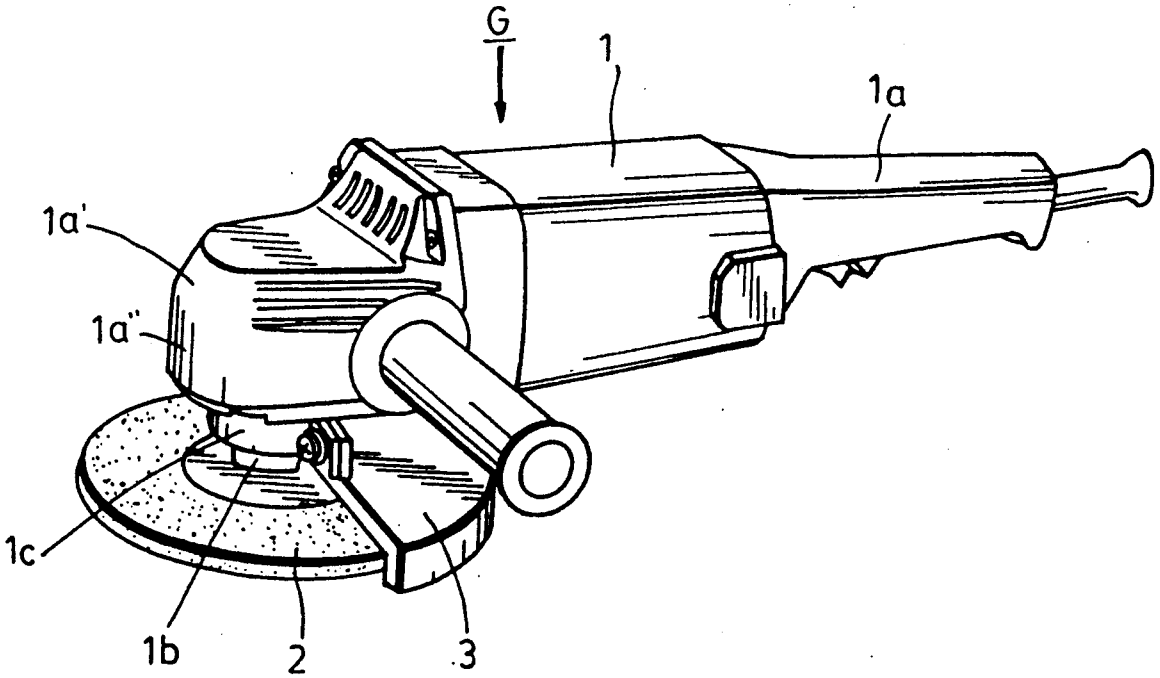
FIG.1 PRIOR ART
FIG. 1 is a schematic view of a conventional portable grinding machine.

In the detailed description of the preferred embodiment, it should be noted that like elements are indicated by the same reference numerals throughout the disclosure. FIGS. 2 to 7 show a preferred embodiment of the present invention.

Figure 2:
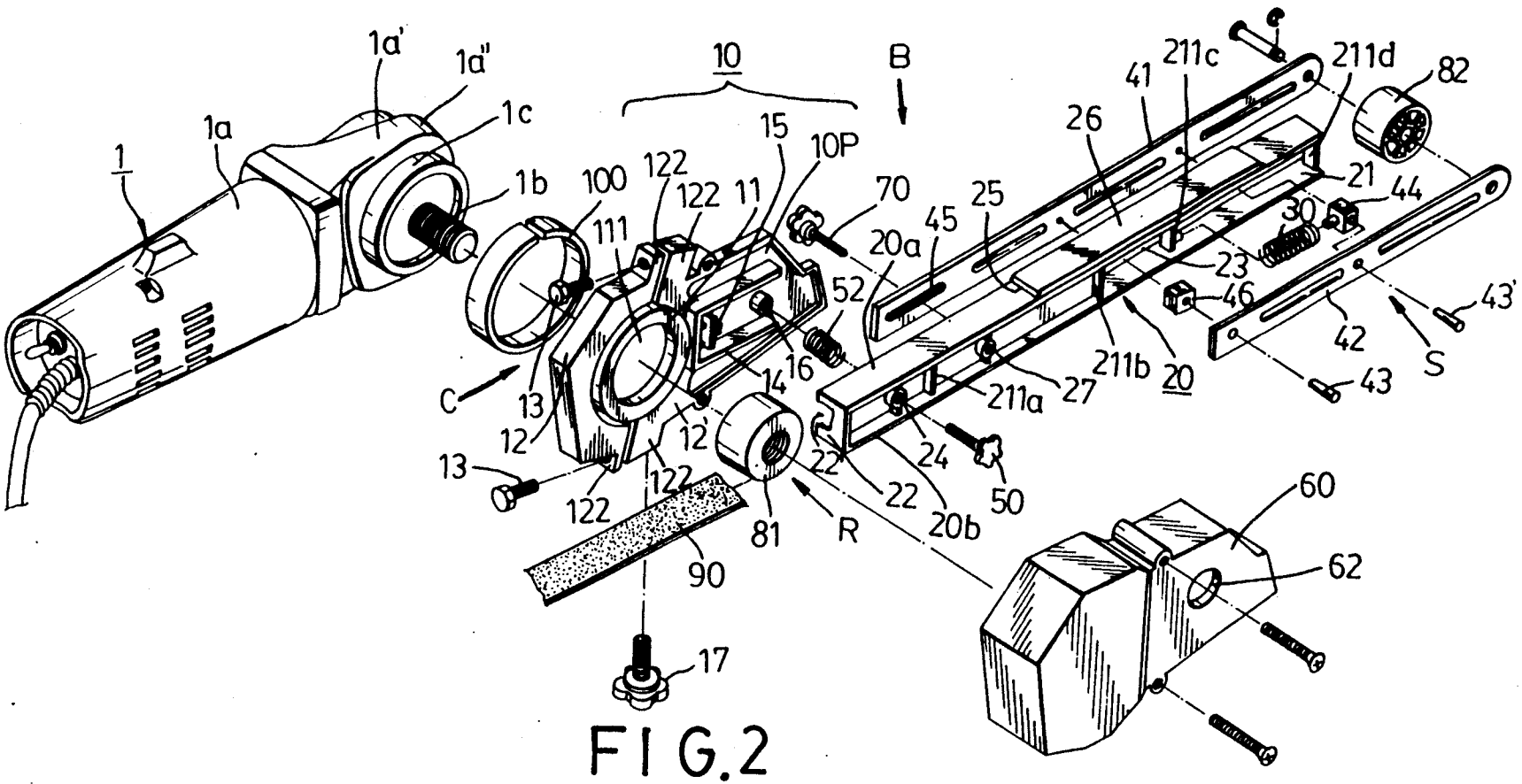
FIG. 2 is an exploded view of a preferred embodiment of a sand belt device of the present invention.
Figure 3:
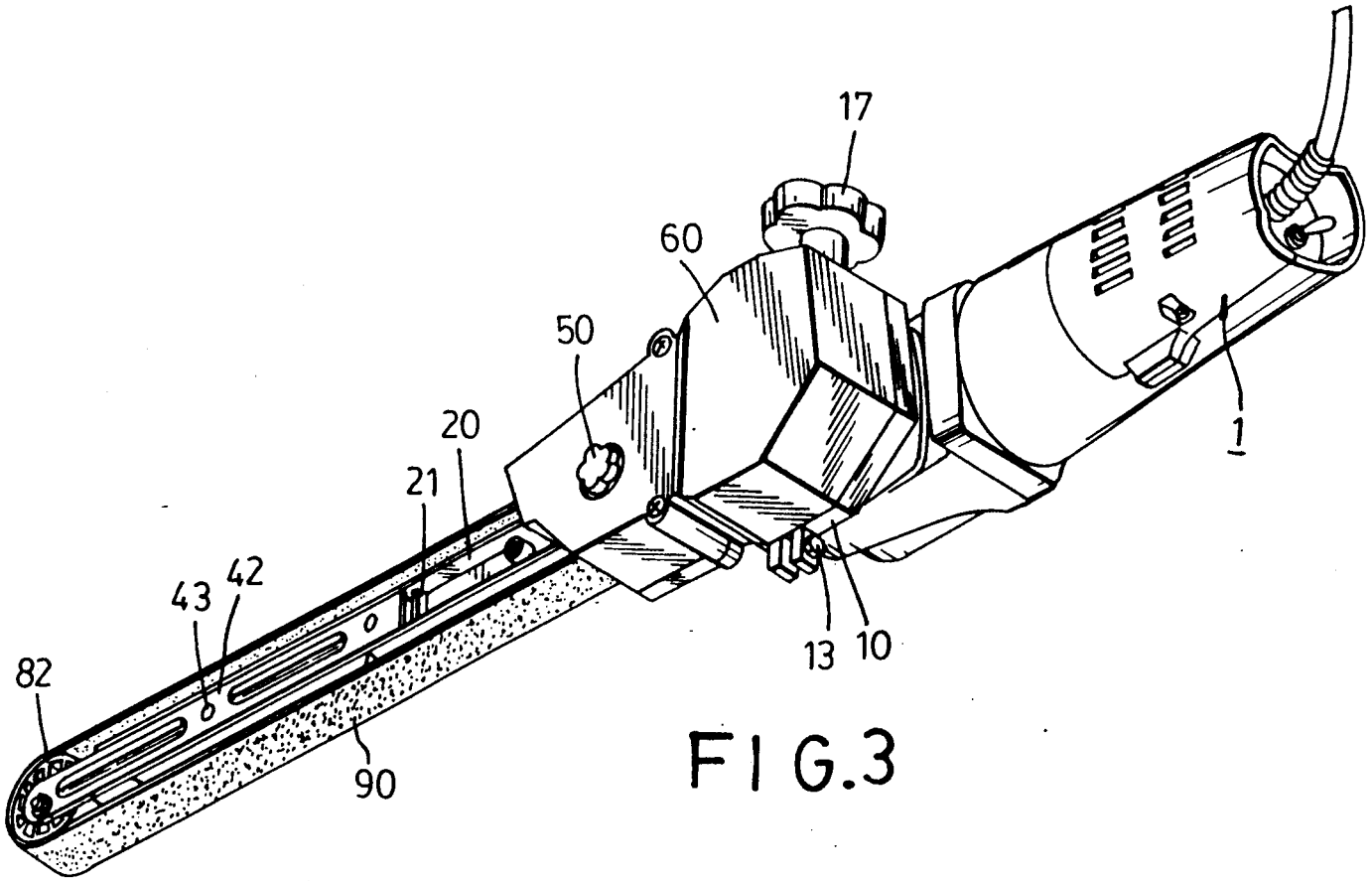
FIG. 3 is an assembled view showing the preferred embodiment when mounted to a body portion of the conventional portable grinding machine shown in FIG. 1.

Referring to FIGS. 2 to 3, a sand belt device (B) of the preferred embodiment, which can be mounted detachably on the body portion (1) of the portable grinding machine (G) shown in FIG. 1, includes a positioning member (10), a roller unit (R) which includes a driving roller (81) and a driven roller (82), an elongated belt frame (20), a supporting means (S) for supporting the driven roller (82), and an endless sand belt (90).

Figure 2A:
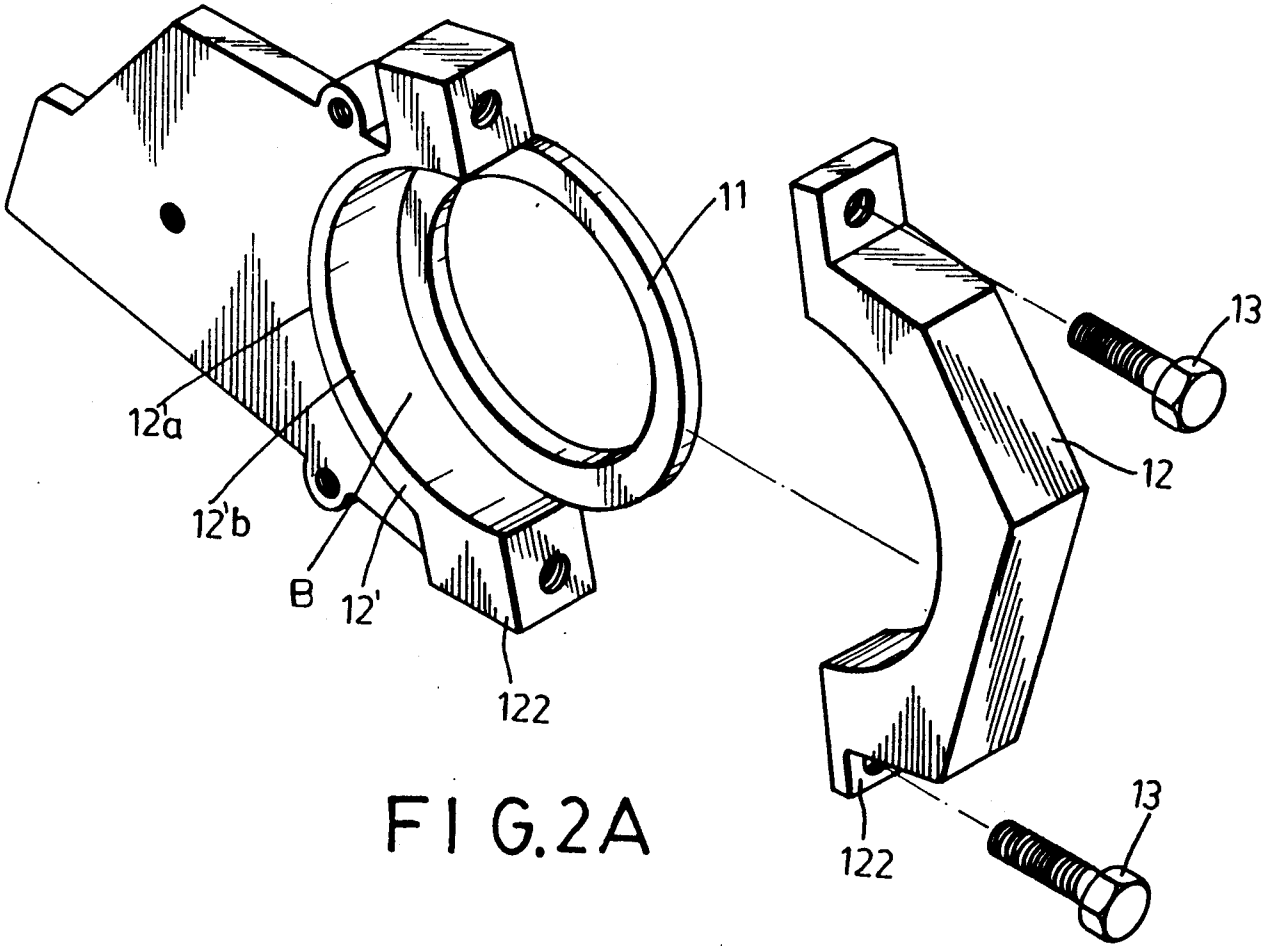
FIG. 2A is a perspective view of a positioning member of the preferred embodiment in FIG. 2.

The positioning member (10) has a front part and a rear part which has a clamp mechanism (C) that includes a substantially semicircular first member (12') and a substantially semicircular second member (12). Each of the first and second members (12', 12) has a pair of lugs (122). The lugs (122) of the second member (12) can engage adjustably and detachably the lugs (122) of the first member (12') by means of screws (133) so that the second member (12) is attached adjustably and detachably to the first member (12') in order to clamp tightly the annular flange (1*c*) of the body portion (1) when the first and second members (12', 12) are sleeved around the annular flange (1*c*). The clamp mechanism (C) further includes a C-shaped packing ring (100) which is sleeved around the annular flange (1*c*) and which is disposed between the annular flange (1*c*) and the first and second members (12', 12) in order to improve the tightness of the clamp mechanism (C) when the first and second members (12', 12) clamp the annular flange (1*c*) therebetween. The first member (12') has a front convex side (12'*a*) and a rear concave side (12'*b*), as shown in FIG. 2A. The clamp mechanism (C) further includes a ring member (11) which protrudes rearward from the rear concave side (12'*b*) of the first member (12') in order to cover the C-shaped packing ring (100) when the first and second members (12', 12) clamp the annular flange (1*c*) with the C-shaped packing ring (100) provided therebetween so as to prevent the release of the C-shaped packing ring (100). The rotatable shaft (1*b*) of the body portion (1) extends out of a hole (111) of the ring member (11) when-the clamp mechanism (C) clamps the annular flange (1*c*). The front part of the positioning member (10) includes a plate member (10*p*) which extends forwardly from the front convex side (12'*a*) of the first member (12'). The front part further includes a substantially U-shaped flange (14) which protrudes from the plate member (10*p*) and which has a free end extending forward, a protrusion (15) which projects from the plate member (10*p*) and which is disposed inside the U-shaped flange (14), and a tubular fastening projection (16) which is formed with interior threads.

The driving roller (81) of the roller unit (R) is mounted detachably on the rotatable shaft (1*b*) and rotates with the same.

The elongated belt frame (20) includes an elongated first face (20*a*), an elongated second face (20*b*) and a plurality of reinforcing ribs (211*a*, 211*b*, 211*c*, 211*d*) which connect the first and second faces (20*a*, 20*b*). A rear side (22) of the elongated belt frame (20) is formed with a recess (22') to engage the protrusion (15) on the plate member (10*p*) while the front ends of the first and second faces (20*a*, 20*b*) are fitted frictionally in the U-shaped flange (14). The elongated belt frame (20) has two tubular fastening members (24, 27) which are mounted respectively between the first face (20*a*) and the second face (20*b*) and which are disposed respectively in rear of the tubular fastening members (221*a*, 221*b*). An adjustable fastener (50) passes through the tubular fastening member (24) and engages the tubular fastening projection (16) in order to join the elongated belt frame (20) and the plate member (10*p*). The adjustable fastener (50) may be a bolt. A spring (52) is sleeved around the tubular fastening projection (16) and is disposed between the plate member (10*p*) and the elongated belt frame (20) in order to bias the elongated belt frame (20) outward. The first and second faces (20*a*, 20*b*) and the ribs (211*b*, 211*c*) define a first space (23) therebetween. The first and second faces (20*a*, 20*b*) and the ribs (211*c*, 211*d*) define a second space (21) therebetween.

The supporting means (S) includes a pair of opposite spaced elongated plate members (41, 42) which are disposed respectively beside the elongated belt frame (20) in the longitudinal direction of the same. The elongated plate member (41) has a rear end formed with an elongated slot (45). An adjustable fastener (70) passes through the elongated slot (45) and the tubular fastening member (27) so as to join the elongated plate member (41) and the elongated belt frame (20). The adjustable fastener (70) may be a bolt. Each of the elongated plate members (41, 42) has a front end extending forward relative to the elongated belt frame (20) in order to hold rotatably the driven roller (82). A first connector (46) is mounted in the elongated belt frame (20) and is provided movably in the first space (23). A first pin (43) passes through the elongated plate member (42), the first connector (46) and the elongated plate member (41) so as to join the elongated plate members (41, 42). A second connector (44) is mounted in the elongated belt frame (20) and is provided movably in the second space (21). A second pin (43') passes through the elongated plate member (42) , the second connector (44) and the elongated plate member (41) so as to join the elongated plate members (41, 42). A compression spring (30) is provided between and is connected to the reinforcing rib (211*c*) and the second connector (44) in order to bias the second connector (44) forward.

The endless sand belt (90) passes over the driving roller (81), the first and second faces (20*a*, 20*b*) of the elongated belt frame (20) and the driven roller (82). The endless sand belt (90) is actuated rotatably by the driving roller (81).

A guiding piece is attached to the first face (20*a*) of the elongated belt frame (20) in order to facilitate rotation of the sand belt (90). The guiding piece includes a lower plastic layer (25) which is attached to the first face (20*a*), and an upper graphite layer (26) which is attached to the plastic layer (25) and which can minimize the heat generated due to friction.

A housing (60) is attached detachably to the positioning member (10) by means of screws so as to cover the positioning member (10). The housing (60) has a hole (62) through which a head of the adjustable fastener (50) protrudes.

A handle member (17) is attached detachably to the lug (122) of the first member (12') of the positioning member (10).

It is noted that the size of the C-shaped packing ring (100) is determined according to the size of the annular flange (1c) of the body portion (1) of the portable grinding machine which is in use. The driven roller (82) can be made from a mixture of metal powder with oily substance, and has radial blades formed therein so that the driven roller (82) can minimize the friction force and the heat which is generated when the sand belt (90) rotates.

Figure 4:
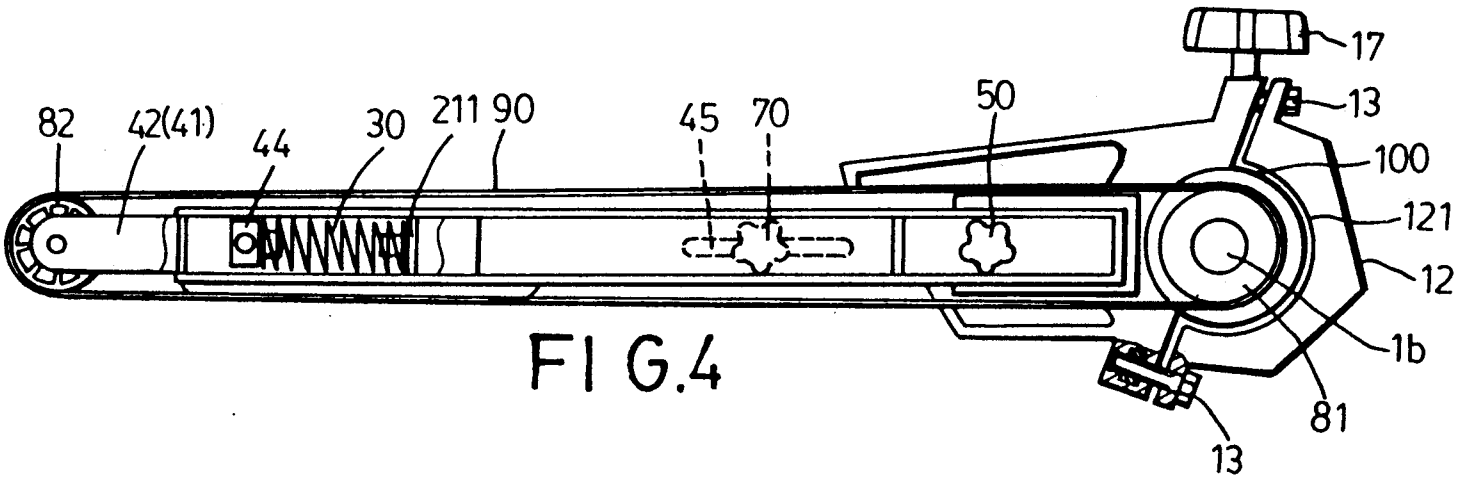
FIG. 4 is a side view of the preferred embodiment showing a sand belt passing over a roller unit and an elongated belt frame of the preferred embodiment.
Figure 5:
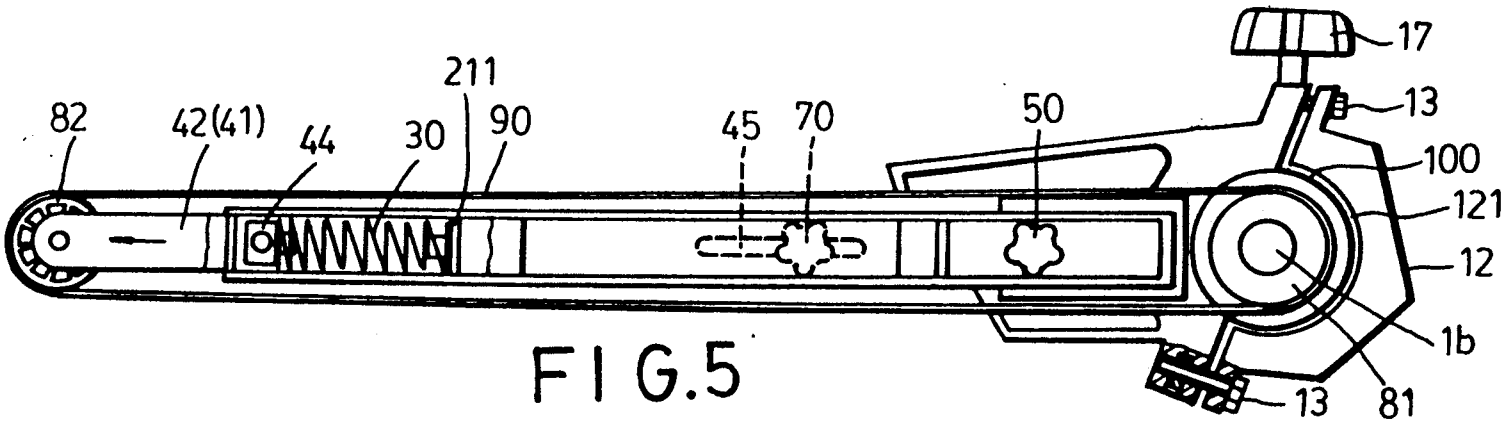
FIG. 5 shows a pair of elongated plate members of the preferred embodiment when moved forward in order to increase the tension of the sand belt.

FIGS. 4 and 5 show that the elongated plate members (41, 42) can be moved relative to the elongated belt frame (20) and are attached detachably to the elongated belt frame (20) by means of the adjustable fastener (70). The adjustable fastener (70) is released, while the compression spring (30) biases the second connector (44) forward so as to permit the elongated plate members (41, 42) to move forward in order to increase the tension of the sand belt (90). Thus, the tension of the sand belt (90) can be adjusted. Since the elongated plate members (41, 42) can be movable relative to the elongated belt frame (20), the mounting of the sand belt (90) is easy and convenient.

Figure 6:
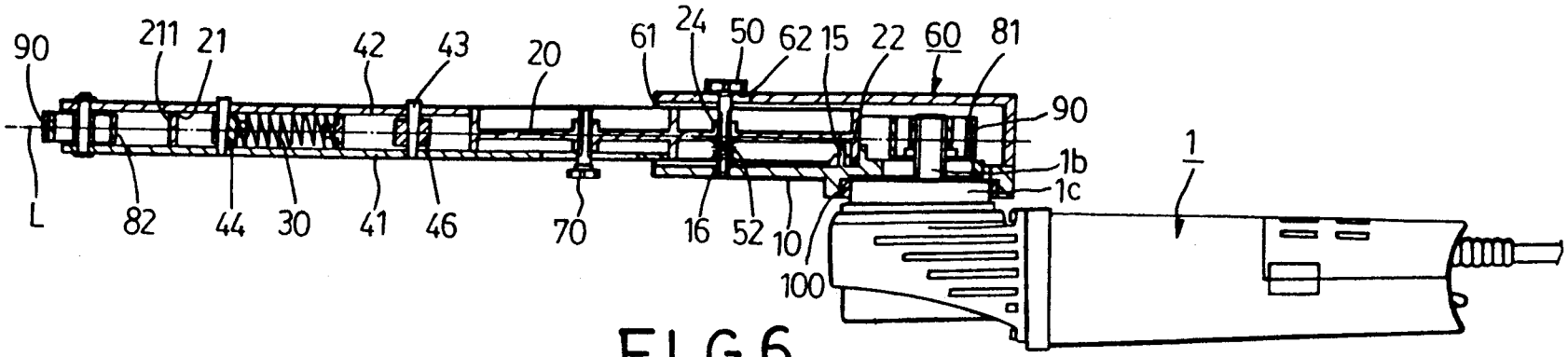
FIGS. 6 and 7 are sectional views of the preferred embodiment showing how to adjust the position of the elongated belt frame relative to the positioning member of the preferred embodiment.
Figure 7:
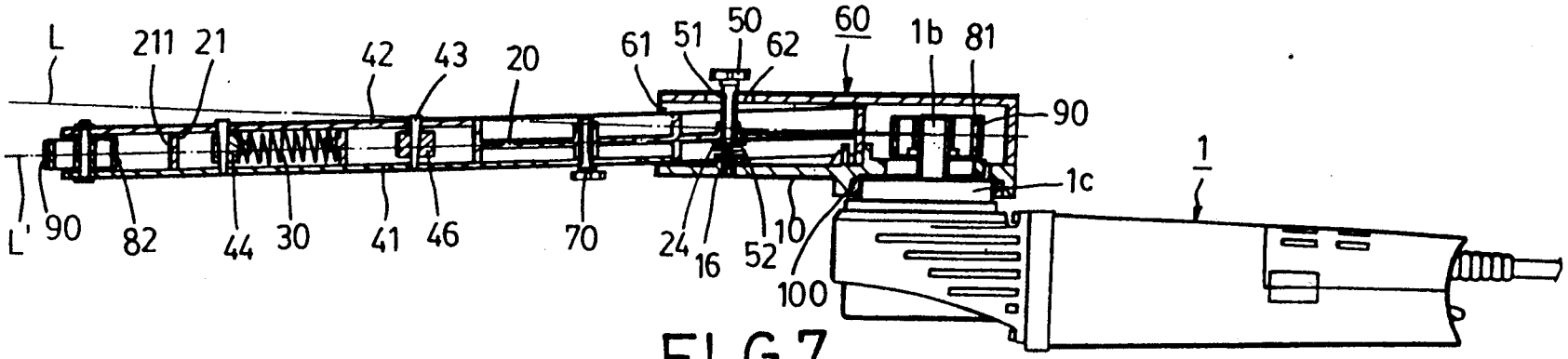

FIGS. 6 and 7 show how to adjust the position of the elongated belt frame (20) relative to the positioning member (10). The elongated belt frame (20), which is positioned originally along the phantom line (L), can be moved to the phantom line (L') by threading the fastener (50) toward the positioning member (10). Furthermore, the elongated belt frame (20) can be moved from the position along the phantom line (L') to the position along the phantom line (L) by releasing the fastener (50) while the spring (52) biases the elongated belt frame (20) outward. Thus, the position of the elongated belt frame (20) relative to the positioning member (10) can be adjusted so as to maintain the elongated belt frame (20) in a proper position.

Therefore, the preferred embodiment can be mounted easily to a variety of portable grinding machines with different annular flanges so as to replace a grinding wheel in order to smooth and brighten a surface of a workpiece. Once the conventional grinding machine is provided with the present invention, it can be used for grinding and polishing.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A sand belt device which can be mounted detachably on a body portion of a portable grinding machine, said body portion including a casing, a rotatable shaft which extends out from said casing, and an annular flange which protrudes from said casing and which is disposed around said rotatable shaft, said sand belt comprising:

a positioning member having a front part and a rear part which is fitted tightly and detachably around said annular flange of said body portion of said portable grinding machine, said rear part having a hole through which said rotatable shaft of said body portion passes;

a roller unit including a driven roller and a driving roller which is mounted detachably on said rotatable shaft of said body portion and which is rotatable with said rotatable shaft;

an elongated belt frame having a front end and a rear end that is attached stationary and detachably to said front part of said positioning member, said elongated belt frame further having an elongated first face which extends from said rear end to said front end, and an elongated second face which is opposite to and spaced from said elongated first face;

means for supporting said driven roller so as to position said driven roller in front of said elongated belt frame, said supporting means being mounted movably and detachably to said elongated belt frame; and an endless sand belt passing over said driving and driven rollers of said roller unit and said elongated first and second faces of said elongated belt frame, said endless sand belt being actuated to rotate by said driving roller;

wherein said rear part of said positioning member includes a clamp mechanism which has a substantially semicircular first member and a substantially semicircular second member, said first member having a front convex side and a rear concave side, said second member being attached adjustably and detachably to said first member in order to clamp tightly said annular flange of said body portion when said first and second members are sleeved around said annular flange, said first and second members defining cooperatively said hole of said rear part therebetween.

2. A sand belt device as claimed in claim 1, wherein said clamp mechanism further includes a C-shaped packing ring which is provided between said annular flange of said body portion and said first and second members in order to improve the tightness of said clamp mechanism.

3. A sand belt device as claimed in claim 2, wherein said front part of said positioning member includes a plate member extending forward from said front convex side of said first member of said clamp mechanism, said front part further including a substantially U-shaped flange, which protrudes from said plate member and which has a free end extending forward, and a protrusion which projects from said plate member and which is disposed inside said U-shaped flange.

4. A sand belt device as claimed in claim 3, wherein said rear end of said elongated belt frame is formed with a recess to engage said protrusion on said plate member of said positioning member while said rear end of said elongated belt frame is fitted frictionally in said U-shaped flange, said sand belt device further having an adjustable first fastener which joins said rear end of said elongated belt frame and said plate member of said front part of said positioning member, and a first spring which is provided between said rear end of said elongated belt frame and said plate member of said front part and through which said first fastener passes to join said elongated belt frame and said plate member.

5. A sand belt device as claimed in claim 4, wherein said supporting means includes a pair of opposite spaced elongated plate members which are disposed respectively beside said elongated belt frame between said elongated first and second faces of said elongated belt frame in a longitudinal direction of the same, each of said elongated plate members having a front end extending forward relative to said elongated belt frame so as to hold rotatably said driven roller.

6. A sand belt device as claimed in claim 5, wherein one of said elongated plate members of said supporting means has a rear end formed with an elongated slot, said supporting means further including: an adjustable second fastener which passes through said elongated slot and which engages said elongated belt frame in order to join said front end of said one of said elongated plate members and said elongated belt frame; a connector which is mounted movably in said elongated belt frame and which is disposed adjacent to said front end of said elongated belt frame in order to connect said two elongated plate members; and a second spring which is provided in said elongated belt frame and which is disposed in rear of said connector so as to bias said connector forward.

7. A sand belt device as claimed in claim 3, wherein said clamp mechanism of said positioning member further includes a ring member which protrudes rearward from said rear concave side of said semicircular first member in order to cover said C-shaped packing ring when said semicircular first and second members clamp said annular flange of said body portion with said C-shaped packing ring provided therebetween so as to prevent the release of said C-shaped packing ring.

8. A sand belt device which can be mounted detachably on a body portion of a portable grinding machine, said body portion including a casing, a rotatable shaft which extends out from said casing, and an annular flange which protrudes from said casing and which is disposed around said rotatable shaft, said sand belt comprising:

a positioning member having a front part and a rear part which is fitted tightly and detachably around said annular flange of said body portion of said portable grinding machine, said rear part having a hole through which said rotatable shaft of said body portion passes;

a roller unit including a driven roller and a driving roller which is mounted detachably on said rotatable shaft of said body portion and which is rotatable with said rotatable shaft;

an elongated belt frame having a front end and a rear end that is attached stationary and detachably to said front part of said positioning member, said elongated belt frame further having an elongated first face which extends from said rear end to said front end, and an elongated second face which is opposite to and spaced from said elongated first face;

means for supporting said driven roller so as to position said driven roller in front of said elongated belt frame, said supporting means being mounted movably and detachably to said elongated belt frame; and an endless sand belt passing over said driving and driven rollers of said roller unit and said elongated first and second faces of said elongated belt frame, said endless sand belt being actuated to rotate by said driving roller; and a guiding piece which is attached to one of said elongated first and second faces of said elongated belt frame in order to facilitate rotation of said sand belt, said guiding piece including a plastic layer which is attached to said one of said elongated first and second faces, and a graphite layer which is attached to said plastic layer.

* * * * *